US006494216B1

(12) United States Patent
Hirata

(10) Patent No.: US 6,494,216 B1
(45) Date of Patent: Dec. 17, 2002

(54) CASTANET TYPE HAIR IRON

(75) Inventor: Yoshihiro Hirata, Kyoto (JP)

(73) Assignee: Phild Co., Ltd., Kyoto (JP)

( * ) Notice: Subject to any disclaimer, the term of this patent is extended or adjusted under 35 U.S.C. 154(b) by 0 days.

(21) Appl. No.: 09/787,061

(22) PCT Filed: Sep. 6, 1999

(86) PCT No.: PCT/JP99/04816

§ 371 (c)(1),
(2), (4) Date: May 29, 2001

(87) PCT Pub. No.: WO00/15070

PCT Pub. Date: Mar. 23, 2000

(30) Foreign Application Priority Data

Sep. 10, 1998 (JP) ..... 10-296007

(51) Int. Cl.[7] ..... A45D 1/00; A45D 2/40; A45D 24/10

(52) U.S. Cl. ..... 132/224; 132/225; 132/118; 132/269

(58) Field of Search ..... 132/224, 225, 132/118, 207, 223, 229, 232, 269, 271; 219/222, 225, 226, 230; 126/408

(56) References Cited

U.S. PATENT DOCUMENTS

| | | | | | |
|---|---|---|---|---|---|
| 236,522 | A | * | 1/1881 | Wilson | 132/224 |
| 278,944 | A | * | 6/1883 | Hauce | 132/224 |
| 1,455,696 | A | * | 5/1923 | Wright | 132/224 |
| 2,243,061 | A | * | 5/1941 | Lamia | 132/224 |
| D211,750 | S | * | 7/1968 | Richards | D49/1 |
| 4,242,567 | A | * | 12/1980 | Carter | 219/225 |
| 4,739,151 | A | * | 4/1988 | Smal | 219/225 |
| D411,333 | S | * | 6/1999 | Smal | D28/35 |
| 5,934,293 | A | * | 8/1999 | Kaizuka | 132/225 |

FOREIGN PATENT DOCUMENTS

| | | |
|---|---|---|
| JP | 54-13777 | 1/1979 |
| JP | 63-8801 | 1/1988 |
| JP | 63-132603 | 8/1988 |
| JP | 4-77801 | 7/1992 |

* cited by examiner

*Primary Examiner*—John J. Wilson
*Assistant Examiner*—Robyn Kieu Doan
(74) *Attorney, Agent, or Firm*—Knobbe, Martens, Olson and Bear, LLP.

(57) ABSTRACT

A hair iron comprises a pair of holding members having a heating surface and/or a pressing surface oppositionally on their interior surfaces being joined so that they can be flexibly opened and closed via a joint member at their ends. Furthermore, a slip preventing surface, a fingertip fitting cup and/or a finger trapping loop is formed on the exterior surface of at least one of the holding members at a position where the fingers A straddle the joint member so that a bundle of hair can be ironed flexibly by a simple finger operation.

9 Claims, 10 Drawing Sheets

CASTANET TYPE HAIR IRON

FIELD OF THE INVENTION

The present invention relates to a hair iron to straighten hair by a finger operation, and in particular to a castanet-like hair iron which makes it possible to iron freely by a simple finger operation.

BACKGROUND OF THE INVENTION

A conventional hair iron has a plane, elongated, virtually rectangular shape, having a heating surface on the interior surface of one end of an arm-like holder bar so that in an ironing operation, a user has to hold the end of a joint member in a position remote from the heating surface. Therefore, the operation is extremely difficult for females having a weak grip.

FIG. 15 shows a perspective view of a conventional arm-like hair iron. This arm-like hair iron 101 comprises elongated rectangular holding members 104 and 105, which are joined via a joint member 106 for flexible opening and closing and have a heating surface 102 and a pressing surface 103 oppositionally on their interior surfaces. Hair ironing operation with this hair iron 101 is performed by gripping the holding members 104 and 105 with fingers A, sandwiching a bundle of hair between the abovementioned heating surface 102 and pressing surface 103 positioned remote from the fingers A and the palm, and controlling the force on the holding members 104 and 105 to iron the bundle of hair. However, in the abovementioned arm-like hair iron 101, it is difficult to control the force because the part for gripping with the fingers A is positioned remote from the abovementioned heating surface and pressing surface when the arm-like holding members 104 and 105 having the abovementioned heating surface 102 and pressing surface 103 oppositionally on their interior surfaces are gripped with the fingers A. This makes it difficult especially for females with a weak grip to sandwich the bundle of hair between the abovementioned heating surface 102 and pressing surface 103 to perform ironing with force. Furthermore, since the heating surface is positioned remote from the fingers, it takes considerable time to master the hair ironing operation which requires a delicate force control.

In a castanet-like hair iron of the present invention, holding members are not conventional arm-like, elongated, virtually rectangular-shaped, but castanet-shaped, in which the reverse sides of the heating surface and pressing surface, namely the exterior surface of the holding members can be directly gripped so that the reverse sides of the heating surface and pressing surface of the holding members, namely the exterior surface of the holding members having the heating surface and the pressing surface oppositionally in their interior surfaces can be pressed with the thumb and the other 3 or 4 fingers while the palm supports the area where the fingers straddle the joining part of said holding members. Thus, the heating surface and the pressing surface can be manipulated more accurately, delicately and easily than those in the conventional arm-like hair iron so that the hair ironing can be flexibly performed.

DISCLOSURE OF THE INVENTION

In order to solve the abovementioned problems associated with the conventional arm-like hair iron, the present invention provides a castanet-like hair iron in which a heating surface and a pressing surface are oppositionally placed on the interior surfaces of a pair of plane, virtually square holding members joined with a joint member at their ends so as to realize an easy hair ironing operation.

Namely, the present invention is fundamentally composed of the following configurations.

(1) A castanet-like hair iron characterized in that a pair of holding members having a heating surface and a pressing surface oppositionally on their interior surfaces are joined via a joint member at their ends and flexibly opened and closed by the pressing force of the palm and fingers which straddle said joint member.

(2) A castanet-like hair iron as described in (1) above, wherein hair heating surfaces are placed oppositionally.

(3) A castanet-like hair iron as described in (1) or (2) above, wherein the exterior surfaces of said holding members are smooth surfaces.

(4) A castanet-like hair iron as described in (1), (2) or (3) above, wherein a slip preventing surface to prevent the fingers from slipping is provided on the exterior surface of at least one of said holding members in immediate proximity to a position where the fingers straddle the joint member.

(5) A castanet-like hair iron as described in any one of (1) through (4) above, wherein said slip preventing surfaces have continuous or discontinuous grooves formed parallel to and/or at right angles to the fingers.

(6) A castanet-like hair iron as described in any one of (1) through (5) above, wherein a fingertip fitting cup to prevent the fingers from slipping is provided on the exterior surface of at least one of said holding members in immediate proximity to a position where the fingers straddle the joint member.

(7) A castanet-like hair iron as described in any one of (1) through (6) above, wherein a finger trapping loop to prevent the fingers from slipping is provided on the exterior surface of at least one of said holding members in immediate proximity to a position where the fingers straddle the joint member.

(8) A castanet-like hair iron as described in (7) above, wherein said finger trapping loop is made of an elastic material in multiple numbers for individual fingers or in one loop for multiple fingers.

(9) A castanet-like hair iron as described in any one of (1) through (8) above, wherein a slip preventing surface, a fingertip fitting cup and/or a finger trapping loop to prevent the fingers from slipping are provided on the exterior surface of at least one of said holding members in immediate proximity to a position where the fingers straddle the joint member.

(10) A castanet-like hair iron as described in any one of (1) through (9) above, wherein the holding members can be strongly pulled in the side direction by grasping them with the palm or fingers at a position so as to straddle the joint member so that a bunch of hair can be ironed to the tip in one stroke by pulling the hair in the side direction while sandwiching it between the holding members.

(11) A castanet-like hair iron as described in any one of (1) through (10) above, wherein an exterior connecting member is extended from the side of the joint member at a position separate from the joining end of said holding members.

In a castanet-like hair iron of the present invention, the holding members having a heating surface and/or a pressing surface oppositionally on their interior surfaces are held with fingers so as to be sandwiched in the palm straddling a joint member which joins said holding members so that an opening and closing motion of the holding members and an opening and closing operation of the fingers are unified. As a result, the hair iron can be easily held and the opening and closing of the holding members can be flexibly and firmly controlled by a delicate finger operation.

Furthermore, in a castanet-like hair iron of the present invention which is operated by placing fingers to straddle said joint member, erroneous actions associated with the opening and closing motion of the holding members can be prevented by providing a slip preventing surface on the exterior surface of at least one of the holding members to prevent the fingers from slipping, although a plain surface on the exterior surface of the holding members causes no problem in operation.

Furthermore, in a castanet-like hair iron of the present invention, a cup is appropriately formed on the exterior surface of at least one of the holding members, corresponding to the thumb and/or a fingertip of the index finger, the middle finger and/or the third finger, which makes it possible to unify the pressing force of the finger and the opening and closing motion of the holding members by fitting the finger in the cup. As a result, the hair iron can be held more securely and the opening and closing of the holding members can be flexibly controlled by a delicate finger operation to provide the desired pressure on the bundle of hair.

Furthermore, in a hair iron of the present invention, since a slip preventing surface to prevent the fingers from slipping or a cup to fit fingertips is provided on the exterior surface of one or both of the holding members, a strong pulling action in the side direction becomes possible so that a bunch of hair can be ironed to the tip in one stroke by pulling the hair to the side while sandwiching it between the holding members, which improves the flexibility of the ironing operation. Similar ironing is possible by providing a finger trapping loop into which a fingertip can be inserted. Further, the exterior connecting member is extended from the side of the joint member in a position separate from the end of the joint member side of said holding members so that the fingers can straddle the joint member without being interfered by the exterior connecting member. As a result, workability can be secured even in cases where a power source or any other exterior connecting member is installed.

Embodiments of the invention will be explained as follows.

A castanet-like hair iron of the present invention is to be explained by several examples, but the present invention is not limited to these examples.

In a hair iron of the present invention, a pair of holding members having a heating surface and a pressing surface oppositionally on their interior surfaces are joined so that they can be opened and closed via a joint member at their ends. An external connecting member such as a cord for a power source is extended from the side of said holding member at a position separate from the end of the joint member. Unfolding springs are installed on both holding members to realize flexible opening and closing.

In this case, it is preferable to provide a slip preventing surface on the exterior surface of at least one of the holding members to prevent the fingers from slipping, although a plain surface on the exterior surface of the holding members causes no problem in operation. On the slip preventing surface, a number of fine, continuous or discontinuous grooves are formed parallel to and/or at right angles to the fingers to make the surface highly frictional.

Furthermore, a cup into which a fingertip of the thumb, the index finger, the middle finger, or the third finger can fit is appropriately formed on the exterior surface of at least one of the holding members. Of course, it is possible to provide both a slip preventing surface and a cup.

Furthermore, in order to secure the opening and closing operation of the holding members, a finger trapping loop to secure a finger is formed on the exterior surface of at least one of the abovementioned holding members, which makes the operation easier. This finger trapping loop placed in a position for fingers straddling the joint member is used to insert fingers for opening and closing of the holding members. This finger trapping loop is made in multiple numbers for individual fingers or in one loop for all fingers for an effective operation of both holding members.

BEST MODE OF CARRYING OUT THE INVENTION

Figure 1:
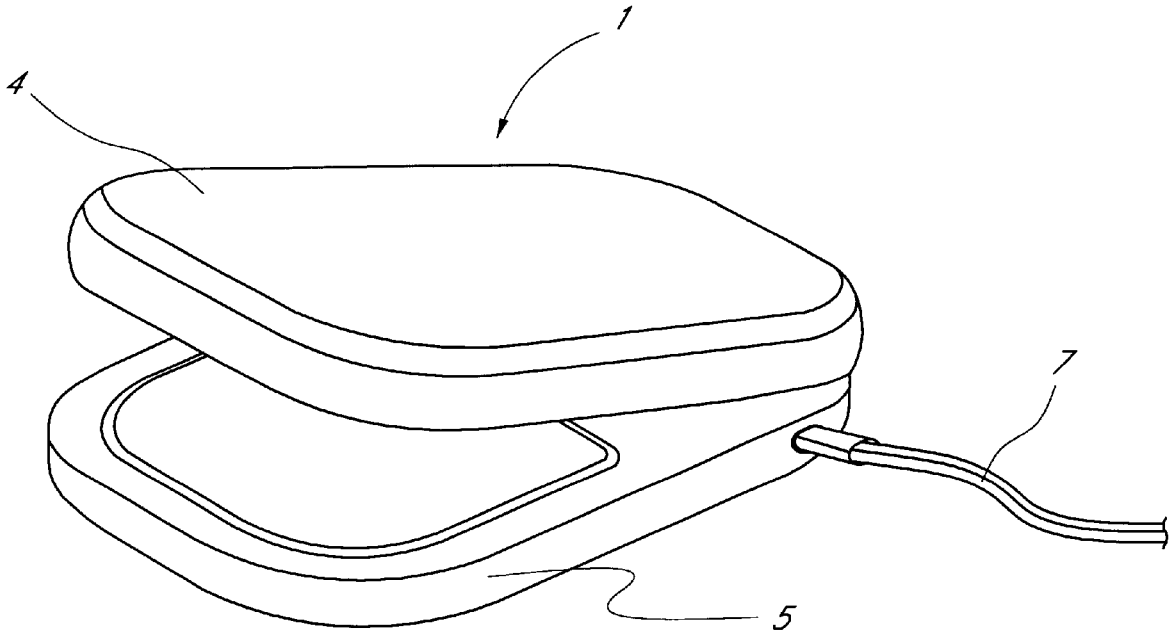
FIG. 1 is a perspective view of the castanet-like hair iron of the present invention.
Figure 2:
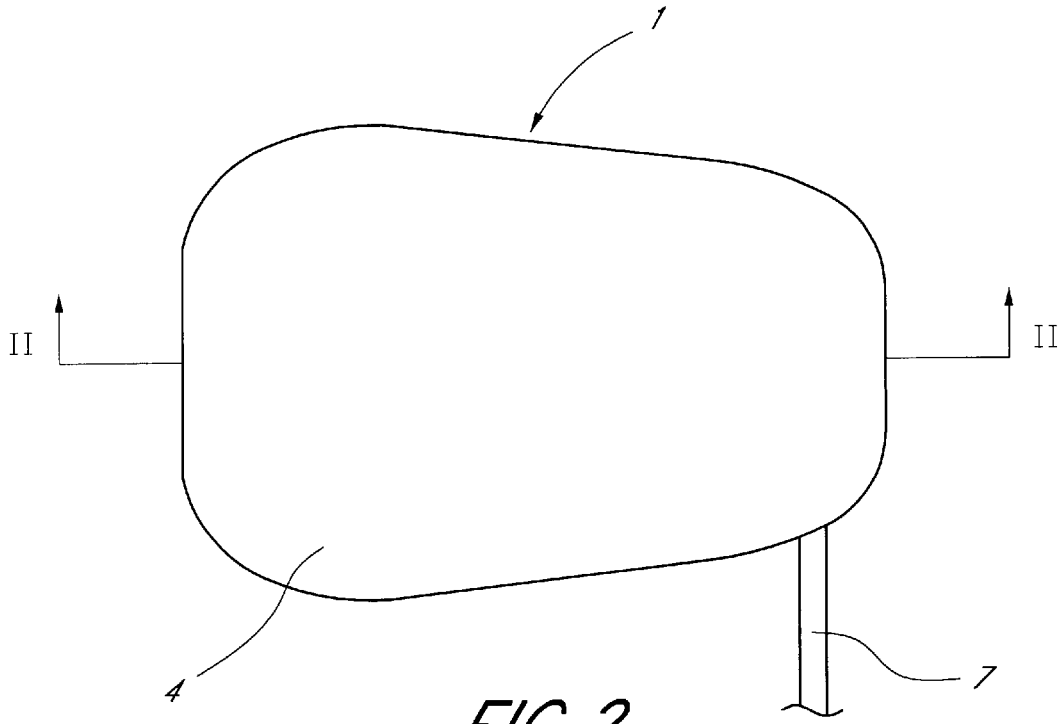
FIG. 2 is a top view of the castanet-like hair iron of the present invention.

A hair iron 1 of the present invention has holding members 4, 5, and a heating surface 2 and a pressing surface 3 are placed oppositionally on the holding members 4, 5. The heating surface 2 and the pressing surface 3 can be placed either on the upper or lower member in the drawings, and both surfaces can be heating surfaces. The ends of the holding members 4, 5 are joined by ajoint member 6 via unfolding springs 10, which enables flexible opening and closing. An exterior connecting member such as a power source cord is extended from the side of the joint member 6 at a position separate from the end of the joint member 6 of the holding members 4, 5. In cases where the pressing surface also serves as the heating surface, the cord can be connected, for example, via the connecting member or the unfolding springs.

Figure 3:
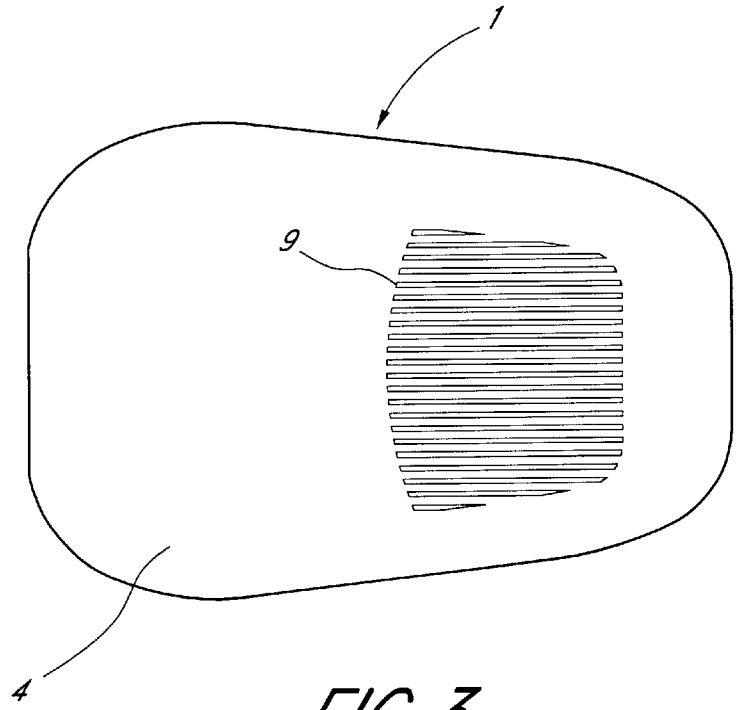
FIG. 3 is a top view of the castanet-like hair iron of the present invention, wherein a slip. preventing surface is provided on the exterior surface.
Figure 4:
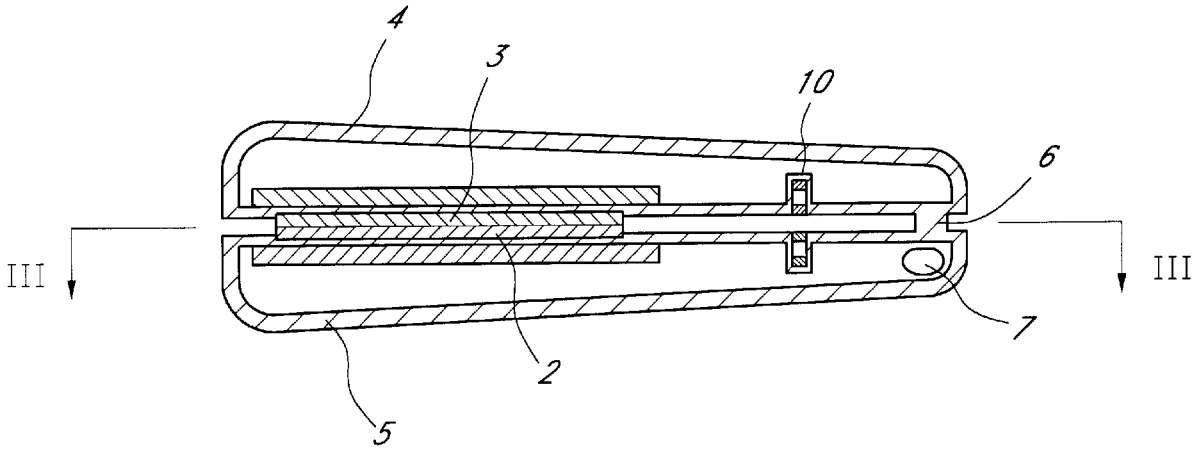
FIG. 4 is a cross-sectional view taken on line II—II of FIG. 2.
Figure 5:
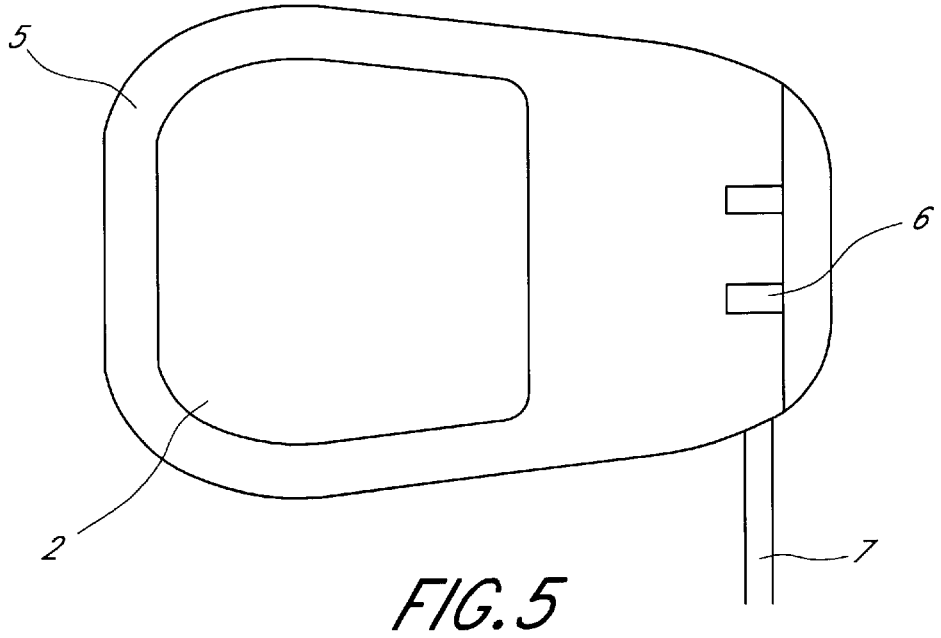
FIG. 5 is a view of the exterior surface (the top in the Figure) taken on line III—III of FIG. 4.
Figure 6:
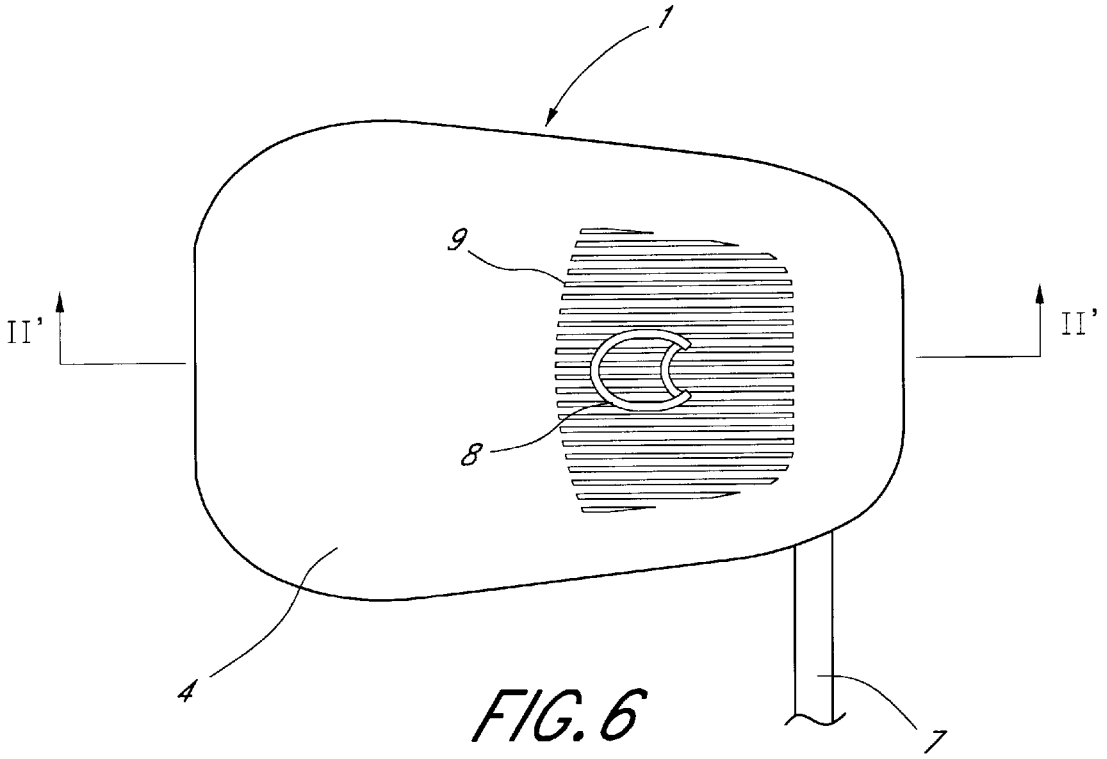
FIG. 6 is the castanet-like hair iron of the present invention, wherein a finger trapping loop is installed on the exterior surface (the top in the Figure)
Figure 7:
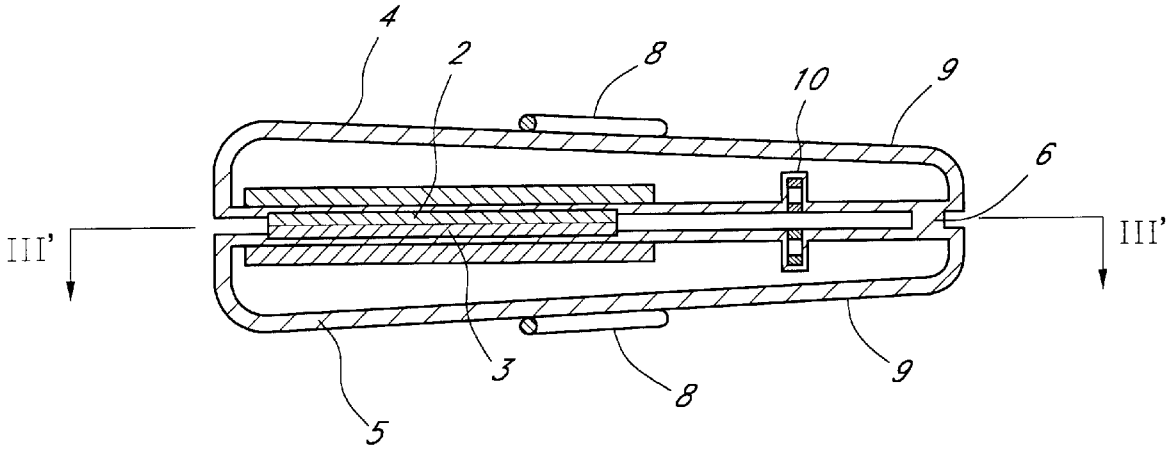
FIG. 7 is a cross-sectional view taken on line II'—II' in FIG. 6. Further.
Figure 8:
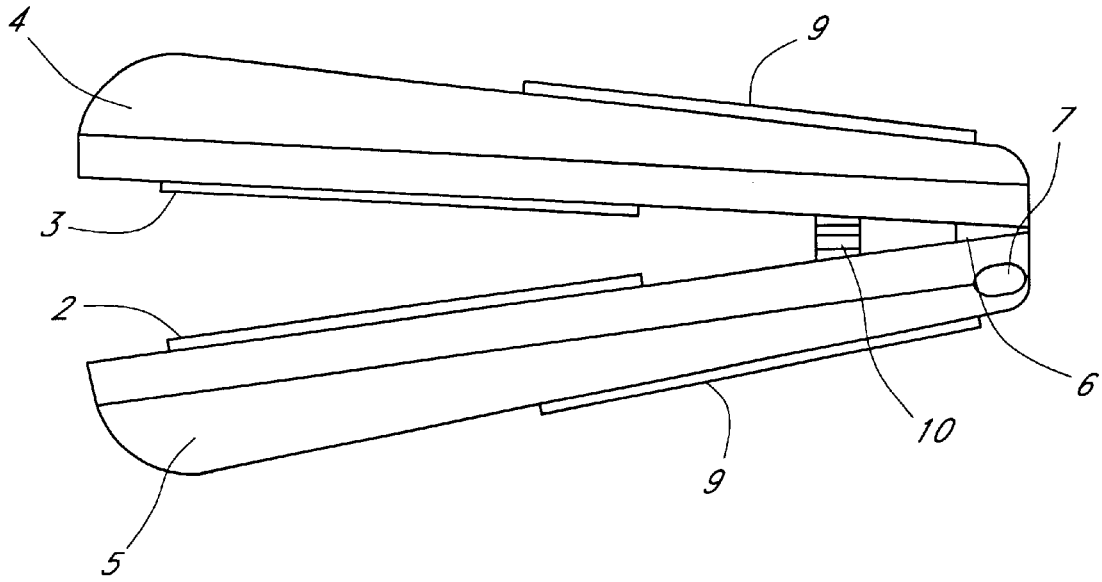
FIG. 8 is the castanet-like hair iron of the present invention having a slip preventing surface on the exterior surface (the top in the Figure) in its open position.
Figure 9:
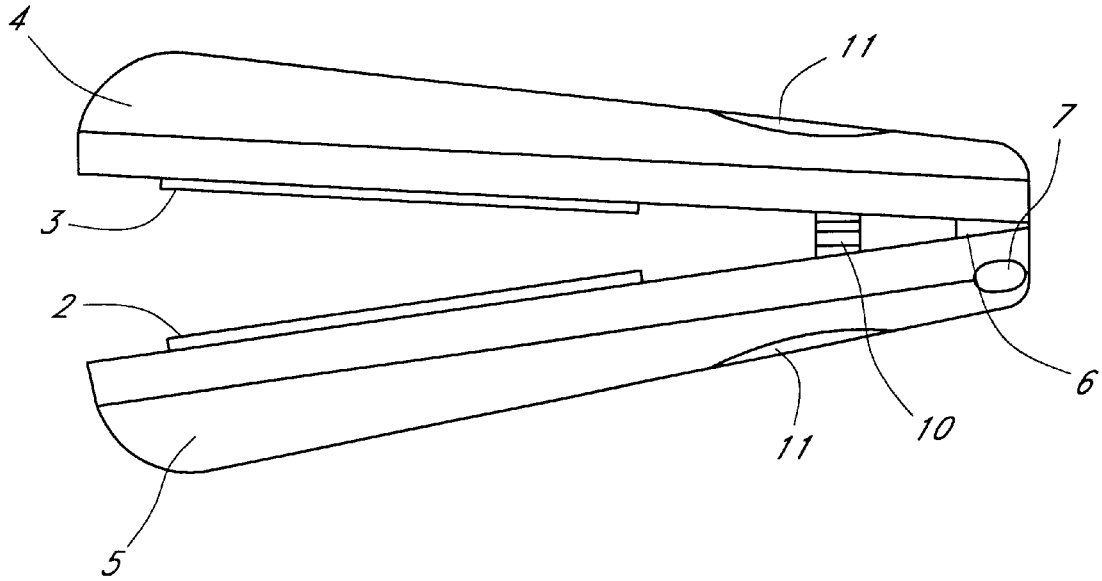
FIG. 9 is the castanet-like hair iron of the present invention having a cup for fingertip fitting on the exterior surface in its open position.
Figure 10:
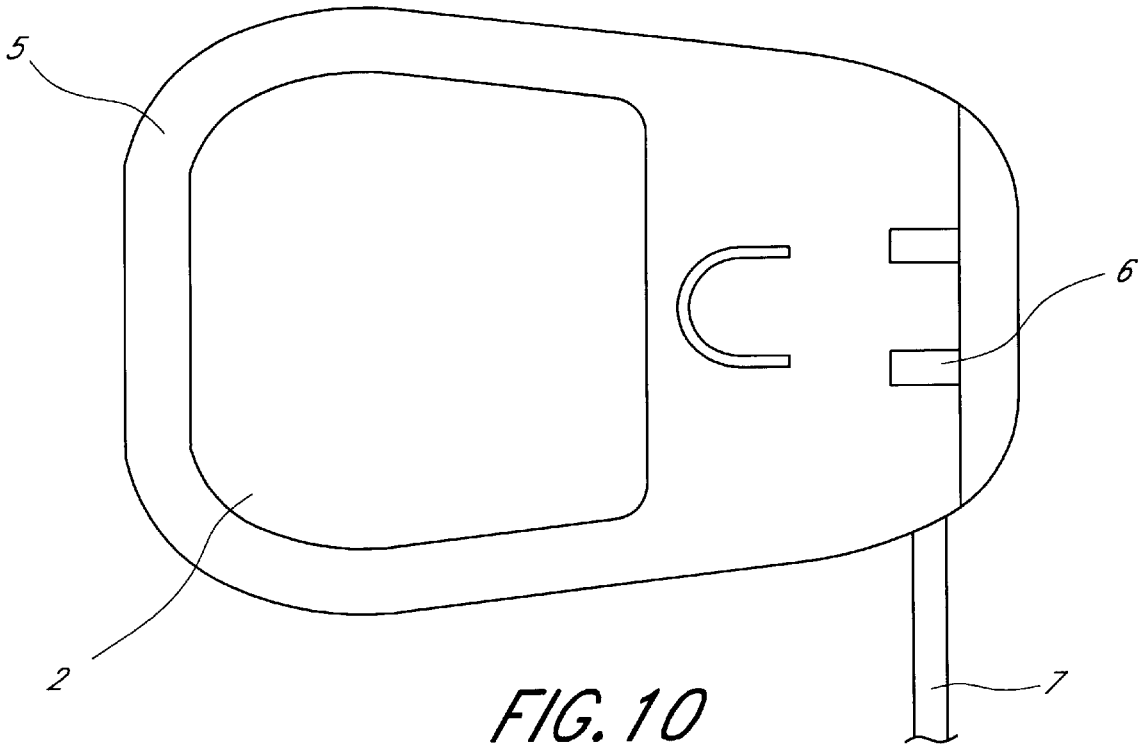
FIG. 10 is the castanet-like hair iron of the present invention having a finger trapping loop on the exterior surface (the top in the Figure)
Figure 11:
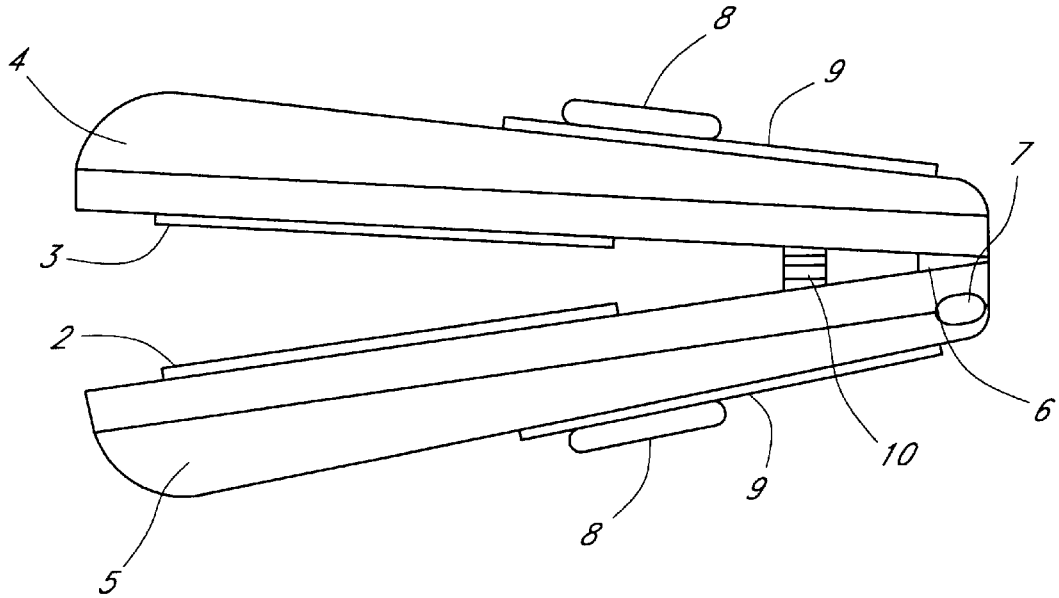
FIG. 11 is the castanet-like hair iron of the present invention having a finger trapping loop on the slip preventing surface on the exterior surface in its open state.

The exterior surface (the top in the drawings) of the holding members 4, 5 can satisfactorily be a smooth surface; however, a slip preventing surface 9 to prevent the fingers from slipping as shown in FIG. 3 or a cup 11 to fit fingertips as shown in FIG. 7 can be provided in order to ease the opening and closing of the holding members. The slip preventing surface 9 can be made highly frictional by forming a multiple number of narrow, continuous or discontinuous grooves extending in the direction parallel and/or at right angles to the fingertips. The cup can be formed on one holding member to fix the thumb and/or on the other holding member to fix the index finger, the middle finger and/or the third finger, or be formed on both holding members. Further, a finger trapping loop 8 as shown in FIG. 6 can be effectively provided to insert a fingertip. This finger trapping loop can be made on the exterior surface of at least one of the holding members singly for the thumb and/or in multiple numbers for individual fingers (usually, three for the index finger, the middle finger and the third finger), or one loop to insert three fingers altogether. An appropriate material for the loop is an elastic rubber string.

Further, the present invention includes appropriate combinations of a slip preventing surface 9, a fingertip fitting cup 11 and a finger trapping loop 8.

Figure 12:
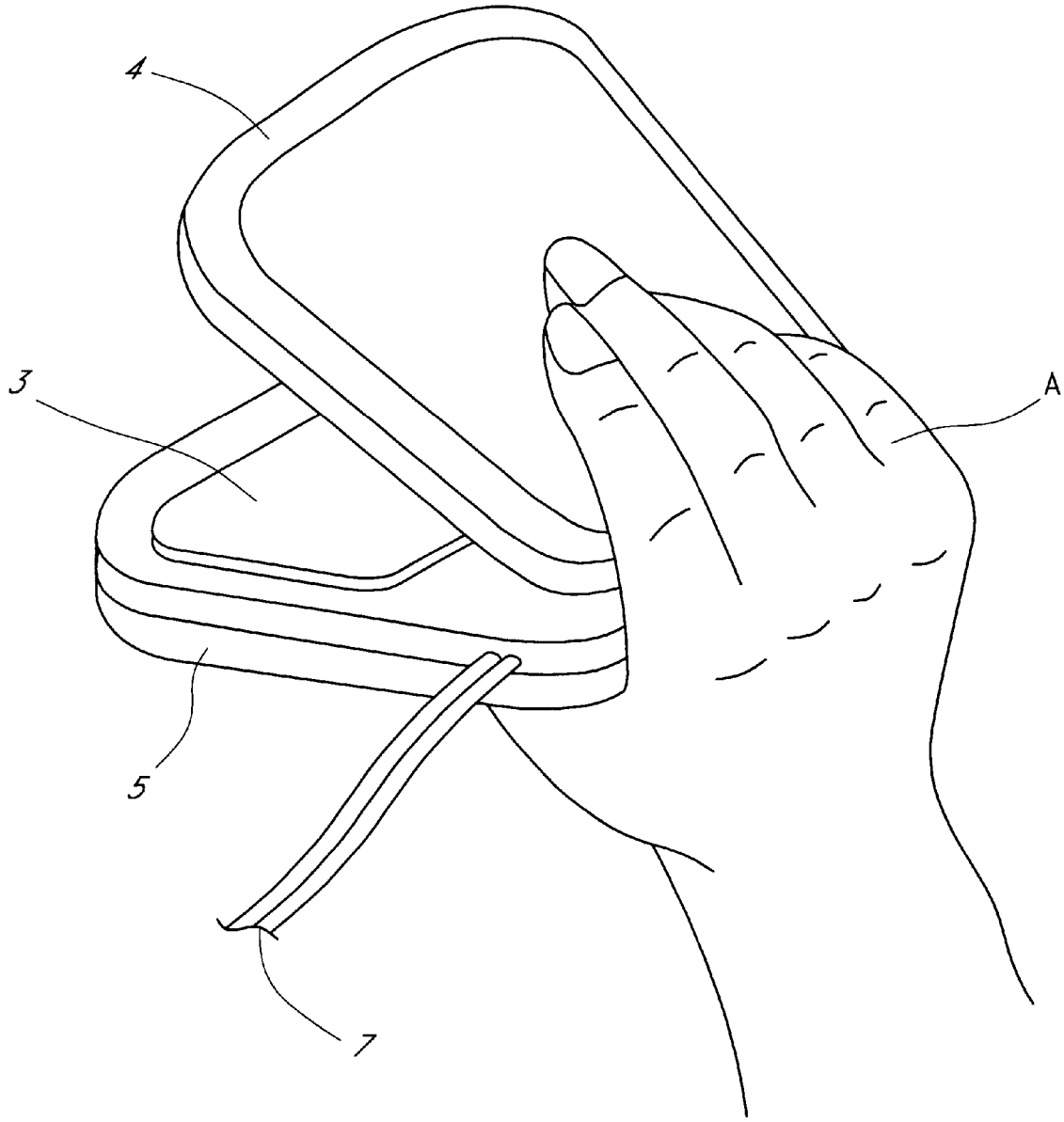
FIG. 12 is the castanet-like hair iron of the present invention in use.
Figure 13:
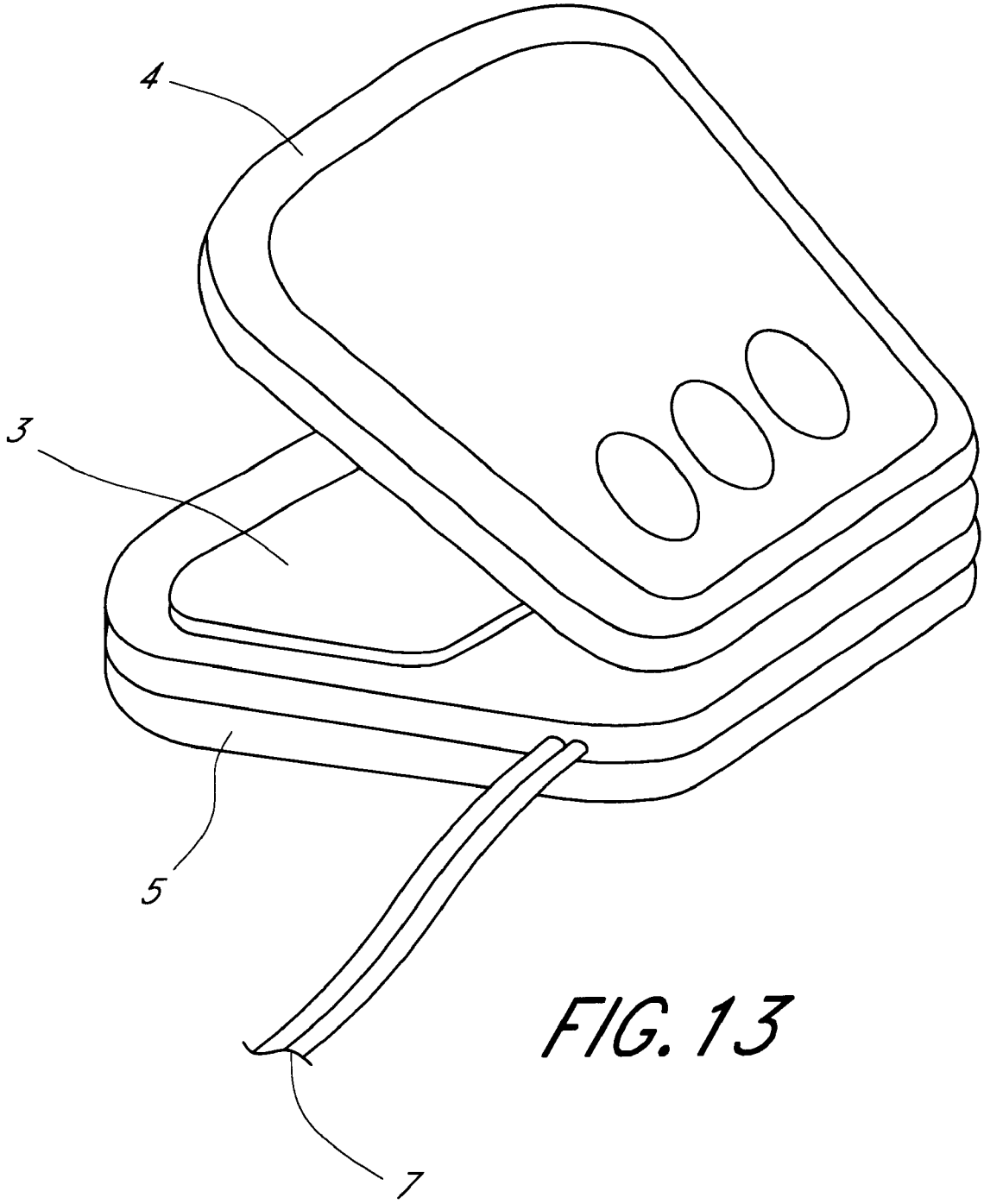
FIG. 13 is a perspective view of the castanet-like hair iron of the present invention having a cup for fingertip fitting on the exterior surface (the top in the Figure) in its open position.
Figure 14:
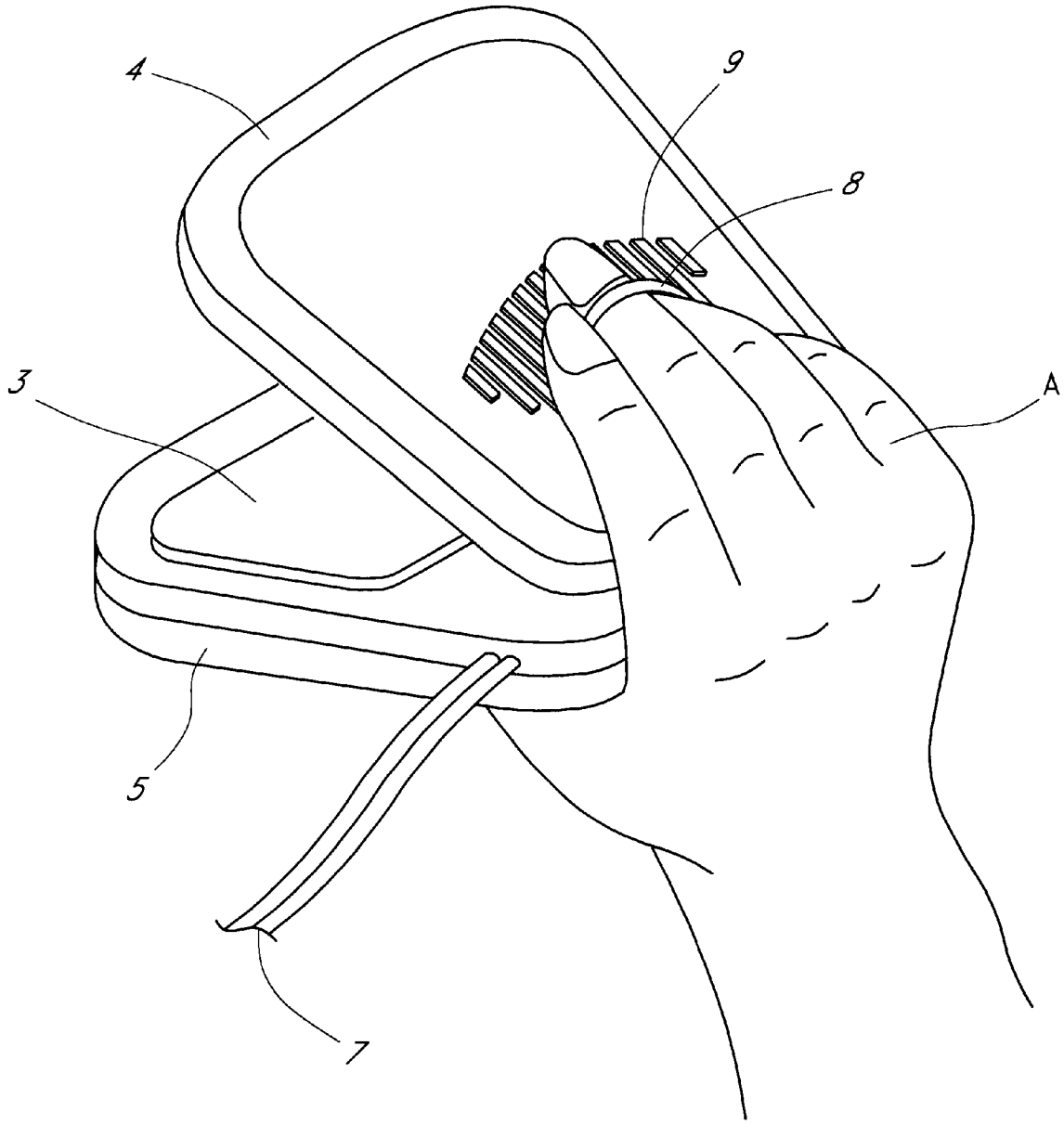
FIG. 14 is the castanet-like hair iron of the present invention having a slip preventing surface and a finger trapping loop on the exterior surface (the top in the Figure) in use.
Figure 15:
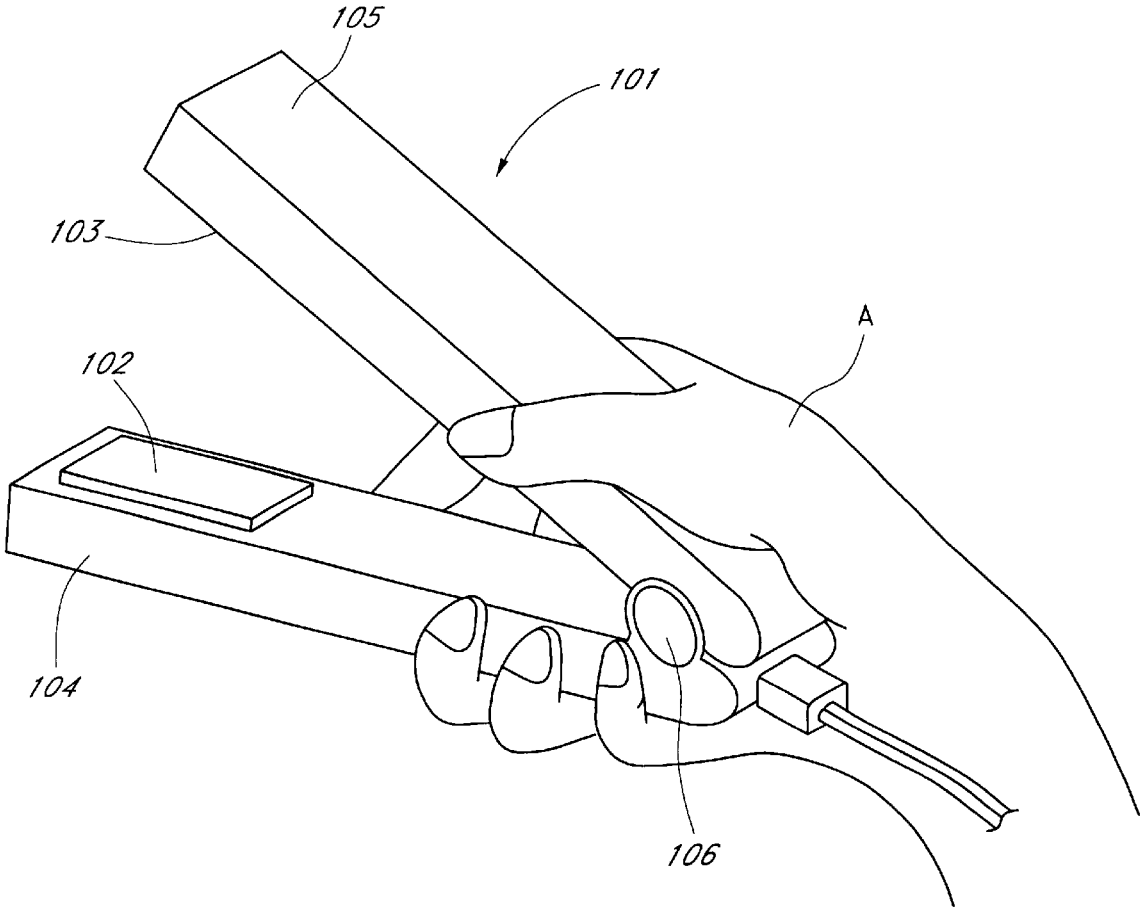
FIG. 15 is a conventional, elongated, virtually rectangular arm-type hair iron in use.

Operation of a castanet-like hair iron of the present invention will be explained referring to FIGS. 12, 13 and 14 which are perspective views showing motions of the castanet-like hair iron of the present invention. A hair iron shown in FIGS. 1 though 14 is taken out from a storage box, a locking device or the like (not shown) is released, and two joining holding members 4 and 5 are spread apart by an unfolding spring 10. A heating surface 2 on the interior surface of the one holding member and a pressing surface 3 on the interior surface of the other holding member can be oppositionally pressed against each other by sandwiching the joining holding members 4, 5 forcefully with fingers. Then, the joining holding members 4 and 5 can be flexibly opened and closed by sandwiching the exterior surface of the holding members in the palm with the thumb and other fingers. In this case, the opening and closing can be more securely performed by providing a finger trapping loop 8, a slip preventing surface 9 or a fingertip fitting cup 11 on the exterior surface of the joining holding members.

In ironing hair using a castanet-like hair iron of the present invention, a bunch of hair is held, as though being bitten, in the space said holding members are pressed with the fingers. If the heating surface 2 is heated, then the sandwiched hair can be effectively ironed. At this moment, if the grip of the fingers is loosened, the hair iron is still held in the palm by being held with the fingers, while the holding members 4, 5 are in an open position. Thus, the hair iron can be held by a weak gripping force without dropping it, and a next ironing operation can be readily continued without interruption.

Thus, in using a castanet-like hair iron of the present invention, fingers A straddle the joining side of the holding members 4, 5 so as to hold the hair iron like holding a castanet so that the opening and closing motion of the holding members is unified with the opening and closing operation with the fingers A, wherein the opening and closing of the holding members can be flexibly controlled by a finger operation while holding the hair iron.

Thus, a bundle of hair can be sandwiched between the holding members and a forceful pressure on the bundle can be avoided by a delicately controlled fingertip, which enables a flexible ironing operation.

Furthermore, since a slip preventing surface to prevent the fingers from slipping is formed on the exterior surface of at least one of the abovementioned holding members, a strong pulling action in the side direction becomes possible so that a bunch of hair can be ironed to the tip in a stroke by pulling the hair to the side while sandwiching it between the holding members, which improves the flexibility of the ironing operation.

In this case, the exterior connecting member is extended from the side of the joint member in a position separate from the end of the joint member side of said holding members so that the fingers can straddle the joint member without being interfered by the exterior connecting member. As a result, workability can be secured even in cases where a power source or any other exterior connecting member is installed.

Possible Industrial Use

A hair iron of the present invention can be supported in the palm of one hand by sandwiching the holding members just like holding a pair of castanet so that the opening and closing operation can be accurate and the opening and closing of the holding members can be freely controlled by a finger operation. Thus, the hair ironing operation can be advantageously easy. Further, a slip preventing surface is provided on the exterior surface of the holding members so that the hair iron can be firmly held. Furthermore, a cup corresponding to a fingertip of a specified finger is formed on the exterior surface of the holding members so that the finger is fixed in position and thus an opening and closing motion of the holding members and an opening and closing operation of the fingers are unified. As a result, the opening and closing of the holding members can be flexibly controlled by a finger operation while holding the hair iron.

Thus, a bundle of hair can be sandwiched between the holding members and a forceful pressure on the bundle can be avoided by a delicately controlled fingertip, which enables a flexible ironing operation.

Furthermore, according to the present invention, a hair iron having a heating surface and/or a pressing surface fits entirely in the palm or fingers so that an ironing operator can grab a bundle of hair between its fingers to more readily understand the condition of the hair, which enables more delicate ironing operation. Furthermore, the operating technique can be learnt more quickly and easily than in the case of a conventional arm-shaped hair iron.

What is claimed is:

1. A castanet-like hair iron comprising:

(i) a pair of holding members for treating hair, each holding member having an inner surface, an outer surface, a front end, and a rear end, wherein the inner surfaces face each other for treating hair, and at least one of the inner surfaces is a heating surface, wherein a portion near the rear end of each holding member is thinner than a portion near its front end, one outer surface being configured to be supported by a thumb and to prevent the thumb from slipping, the other outer surface being configured to be supported by the fingers and to prevent the fingers from slipping, the holding members being flexibly joined using a joint member at the rear ends, whereby the front ends of the holding members open and close via the joint member, wherein the rear ends are configured to be held by the palm;

(ii) a spring member for holding the holding members open, said spring member being provided between the holding members; and (iii) an external connecting member for supplying electric power for heating the heating surface, said external connecting member being drawn from a side of either holding member near its rear end, whereby the holding members are adapted to flexibly open and close via the joint member covered by the palm by movement of the thumb and fingers without substantially bending them.

2. A castanet-like hair iron as claimed in claim 1, wherein hair heating surfaces are placed oppositionally.

3. A castanet-like hair iron as claimed in claim 1, wherein the outer surfaces of said holding members are smooth surfaces.

4. A castanet-like hair iron as claimed in claim 1, wherein said slip preventing configurations of the outer surfaces comprise continuous or discontinuous grooves formed parallel to and/or at right angles to the fingers.

5. A castanet-like hair iron as claimed in claim 1, wherein said slip preventing configurations of the outer surface comprise a fingertip fitting cup provided on the outer surface of at least one of the said holding members in immediate proximity to a position where the fingers straddle the joint member.

6. A castanet-like hair iron as claimed in claim 1, wherein said slip preventing configurations of the outer surfaces comprise a finger trapping loop provided on the outer surface of at least one of the said holding members in immediate proximity to a position where the fingers straddle the joint member.

7. A castanet-like hair iron as claimed in claim 6, wherein said finger trapping loop is made of an elastic material in multiple numbers for individual fingers or in one loop for multiple fingers.

8. A castanet-like hair iron as claimed in claim 1, wherein the holding members can be strongly pulled in the side direction by grasping them with the palm or fingers at a position so as to straddle the joint member so that a bunch of hair can be ironed to the tip in one stroke by pulling the hair in the side direction while sandwiching it between the holding members.

9. A castanet-like hair iron as claimed in any one of claims 1 through 8, wherein an exterior connecting member is extended from the side of the joint member at a position separate from the joining end of said holding members.

* * * * *